US007150177B2

(12) United States Patent
Hellgren

(10) Patent No.: US 7,150,177 B2
(45) Date of Patent: Dec. 19, 2006

(54) HYDRAULIC PRESS WITH A PRESSURE CELL AND A METHOD AND USE FOR IT, WHOSE PRESS BODY CONSISTS OF PRESTRESSED LAMELLAS

(75) Inventor: Keijo Hellgren, Västerås (SE)

(73) Assignee: Avure Technologies AB, Vasteras (SE)

( * ) Notice: Subject to any disclaimer, the term of this patent is extended or adjusted under 35 U.S.C. 154(b) by 332 days.

(21) Appl. No.: 10/415,191

(22) PCT Filed: Nov. 23, 2001

(86) PCT No.: PCT/SE01/02596

§ 371 (c)(1),
(2), (4) Date: Nov. 24, 2003

(87) PCT Pub. No.: WO02/43890

PCT Pub. Date: Jun. 6, 2002

(65) Prior Publication Data

US 2004/0065137 A1 Apr. 8, 2004

(30) Foreign Application Priority Data

Nov. 28, 2000 (SE) ..... 0004368-7

(51) Int. Cl.
*B65D 25/20* (2006.01)
*B30B 11/00* (2006.01)

(52) U.S. Cl. ..... 72/455; 72/57; 72/61; 100/214

(58) Field of Classification Search ..... 72/57, 72/61, 455; 100/214, 231
See application file for complete search history.

(56) References Cited

U.S. PATENT DOCUMENTS

| | | | | | |
|---|---|---|---|---|---|
| 2,771,850 | A | | 11/1956 | Wheelon | 113/44 |
| 3,064,558 | A | * | 11/1962 | Von Platen | 100/214 |
| 3,476,281 | A | * | 11/1969 | Cornish et al. | 72/455 |
| 3,508,429 | A | * | 4/1970 | Staples | 72/455 |
| 3,687,066 | A | * | 8/1972 | Von Platen et al. | 100/214 |
| 3,884,142 | A | * | 5/1975 | Jonsson | 100/214 |
| 3,938,361 | A | | 2/1976 | Claesson et al. | 72/63 |
| 3,992,837 | A | * | 11/1976 | Dahlman et al. | 72/455 |
| 4,155,476 | A | | 5/1979 | Lipiec et al. | 220/3 |
| 4,514,245 | A | | 4/1985 | Chabrier | 156/161 |
| 4,573,335 | A | | 3/1986 | Persson | 72/63 |
| 4,711,111 | A | | 12/1987 | Hellgren | 72/63 |
| 6,000,271 | A | * | 12/1999 | Olsson et al. | 72/455 |

FOREIGN PATENT DOCUMENTS

| | | |
|---|---|---|
| CH | 232717 | 9/1944 |
| SE | 392 822 | 4/1977 |
| SE | 440 995 | 9/1985 |
| SE | 452 436 | 11/1987 |

* cited by examiner

*Primary Examiner*—David Jones
(74) *Attorney, Agent, or Firm*—Harness, Dickey & Pierce, P.L.C.

(57) ABSTRACT

A press of pressure cell type includes a press body part. The press body part comprises a number of plates with the planes of the plates oriented parallel to the planes of the adjacent plates. Each plate has a through hole which has the same center axis as the hole of the adjacent plates. Prestressing bands which induce a compressing prestress acting in the planes of the plates are arranged on an external edge surface of each of the plates.

30 Claims, 5 Drawing Sheets

HYDRAULIC PRESS WITH A PRESSURE CELL AND A METHOD AND USE FOR IT, WHOSE PRESS BODY CONSISTS OF PRESTRESSED LAMELLAS

FIELD OF THE INVENTION

The present invention relates to a press of pressure cell type, which comprises a press chamber being enclosed by a force-absorbing press body. The invention also relates to a method for manufacturing a press body part.

BACKGROUND ART

A press of pressure cell type generally comprises a force-absorbing press body which defines a press chamber. In the upper part of the press chamber, a press plate and a diaphragm of rubber or another resilient material are arranged, which together form a pressure cell. The pressure cell communicates with a source of pressure and expands when a pressure medium is supplied. In the lower part of the press chamber, a structural support or a tray is arranged, which comprises a bottom plate having a tray frame. The tray supports a forming tool, a workpiece, a mat of rubber or another resilient material, covering the forming tool and the workpiece.

Presses of pressure cell type are used, among other things, when forming sheet-shaped blanks, for example sheets of steel or aluminium, to short series products within the aircraft industry and the motor industry. The sheet is placed in the press in such a manner that one of its sides faces a forming tool. The resilient diaphragm is arranged on the other side of the sheet. A closed space between the diaphragm and the press plate located above the diaphragm constitutes the pressure cell and this space is filled during the forming process with a pressure medium. By pumping additional pressure medium into the pressure cell, the pressure is increased in the pressure cell and the resilient diaphragm is pressed during stretching against the sheet which, in its turn, is formed round or in the forming tool. When the sheet completely fits to the forming tool, the pressure in the pressure dell is released and the diaphragm is removed, after which the formed component can be taken out of the press.

Another field in which presses of pressure cell type are used is wood compaction when a workpiece of wood is exposed to high pressure, either in a forming tool or on its own. Reasons for compacting wood are, for example, that it is desirable to increase the hardness of the wood, decrease the moisture content or to obtain a phase in pressure impregnation.

A press of pressure cell type according to that mentioned above is known through SE 452 436. Said patent specification discloses a press plant having a forged, cylindrical press body which requires large, heavy filling blocks to provide a press chamber of an essentially rectangular cross-section. In order to handle the large forces to which the press body is exposed in connection with pressing, the body is wound with steel wire. A press of this type has to be ordered before being manufactured and the complicated work of forging and winding the press body requires several months. It usually takes 15–18 months from order to delivery. The delivery itself is very complicated since, on the one hand, the size of a large press makes road or railway transport difficult and, on the other, the weight amounts to tens of tonnes.

Attempts have been made to manufacture lighter presses having less material in relation to the size than conventional presses have. However, technical problems relating to both manufacturing technique and strength have resulted in these presses only managing a limited working pressure that has been too low with respect to the high pressure which is required in a modern press plant, typically up to 1200 bar.

SUMMARY OF THE INVENTION

The object of the present invention is to provide a press of pressure cell type which in comparison with prior-art technique is cheaper and faster to manufacture, as well as easier to handle and transport.

Another object of the invention is to provide a method for manufacturing a press of pressure cell type, which method is quick and easy.

These and other objects which will be evident from the following description are achieved by a press of pressure cell type and a method, which have the features indicated in the appended claims.

According to one aspect of the invention, a press of pressure cell type is provided, which comprises a press chamber which is enclosed by a force-absorbing press body. The press body comprises a number of plate-shaped lamellar means with the planes of the plates oriented parallel to the planes of the plates of adjacent lamellar means. Each lamellar means has a through hole which has the same centre axis as the hole, said centre axis coinciding with the direction of the main axis of the press chamber being enclosed by the holes. Each lamellar means has an internal edge surface which defines the hole and an external edge surface, prestressing means which induce a compressing prestressing acting in the planes of the plates being arranged on the external edge surface of the main part of the lamellar means. Each prestressing means comprises a prestressing element which is wound round a respective lamellar means and is band-shaped and has essentially the same width as the thickness of a lamellar means.

According to another aspect of the invention, a method is provided for manufacturing a force-absorbing press body part. The method comprises the steps of forming plate-shaped lamellar means and providing each of them with a through hole, inducing a lasting compressing prestress which acts in the planes of the plates in at least the majority of the lamellar means by winding a band-shaped prestressing element, which has essentially the same width as the thickness of a lamellar means, round the external edge surface of the lamellar means with the purpose of causing said prestress, and arranging each formed lamellar means having the plane of the plate oriented parallel to the plane of the plate of an adjacent lamellar means so that the through holes obtains a common centre axis and so that the lamellar means constitute a force-absorbing press chamber-enclosing press body part.

In the present application, terms describing position and direction, such as "vertical" and "horizontal", are used. In this application, these terms are defined with respect to the arrangement of the press-body-forming lamellar means. Thus, each lamellar means extends essentially vertically, whereas the direction of the main axis of the press chamber enclosed by the lamellar means is horizontal. In the application, it should also be understood that "over/upwards/above" and "under/downwards/below" are defined with respect to the essential direction of the pressing, i.e. so that a press plate is located above a diaphragm which, in its turn, is located above a bottom plate, which means that vertically is defined as perpendicular to the press plate and horizontally as parallel to the press plate. The above-mentioned definitions have been indicated for sake of clarity since the press of pressure cell type can be inclined in different manners, and due to this fact the relative directions can vary.

The present invention is thus based on the understanding that considerable improvements regarding handling and time expenditure can be provided by means of a press body which is divided into vertical plates and has essentially maintained force-absorbing capability due to applied prestressing means.

Consequently, the invention allows deviation from the traditional manufacturing process of forming an essentially homogeneous press body of two cylinder halves. On the contrary, it is possible to provide a press body which is inhomogeneous by the plate-shaped lamellar means being arranged at a distance from one another. It has been found that an excellent force-absorbing capability is obtained also by means of such a hollow construction which has several operational advantages that will be described below.

A prestressing means which is arranged on the external edge surface of a lamellar means preferably comprises a prestressing element that is wound round the lamellar means, such as metal wire or metal band. According to one advantageous embodiment, the prestressing element is band-shaped and has essentially the same width as the thickness of the lamellar means.

If the main part of the lamellar means is prestressed by a band, the width of which (about 80–200 mm, typically 100–200 mm) essentially equals the thickness of the lamellar means, being wound round the external edge surface of these lamellar means, several advantages will be obtained. For example, there is no essential stress concentration, but a mainly even stress distribution is obtained in the lamellar means. The shape of the lamellar means can be selected in such a manner that optimal stress distribution is achieved, also with relatively few turns of the band. A suitable band is made of spring steel having a thickness of some tens of a millimetre, typically about 0.2 mm. Due to the winding, the lamellar means obtain a considerable length of service, which means that inspections of the press can be performed at reasonable intervals.

Conveniently, each lamellar means is provided with a number of apertures, such as two apertures symmetrically arranged on each side of the hole. In an assembled position, the lamellar means are arranged in such a manner that the apertures in the respective lamellar means have the same centre axis as the corresponding apertures in the other lamellar means. Preferably, a type of coupling means, such as a steel rod, for coupling lamellar means is adapted to run through a respective one of said series of apertures. Thus, these coupling means have a longitudinal extension which is parallel to the direction of the main axis of the press chamber.

The relative distance between two lamellar means is adjustable with the aid of distance means which are arranged on the coupling means. The thickness of the distance means essentially corresponds to the desired relative distance between two neighbouring lamellar means. The distance can be adapted to the stress to which the press body will be subjected when in operation. Preferably, the distance between neighbouring lamellar means, does not vary in the press body, but is similar as regards all lamellar means that are adjacent to one another. The distance means are made of a relatively rigid material and their inner diameter is larger than that of the coupling means at the same time as their outer dimensions are considerably larger than the apertures formed in the lamellar means. It has been found to be especially advantageous to make the thickness of the distance means essentially the same as the thickness of the lamellar means, which means that they can be made of a similar sheet-metal blank.

The coupling means are tightened with the aid of suitable means to a predetermined prestressing condition so as to avoid play and motion in the construction. At the same time the coupling means promotes the structural stability of the construction regarding flexural rigidity, torsional rigidity and resistance to extension in all dimensions.

Between the lamellar means of the press body and the press chamber which is enclosed in the lamellar means, stress distributing elements can be arranged and extend over the press chamber. Conveniently, the stress-distributing elements cooperate with the internal edge surface of each lamellar means and distribute stress or thrust, which arise in connection with pressing in the press chamber along the series of lamellar means. The stress-distributing elements can constitute parts of the wall of the press chamber.

The shape of a preferably central hole which is formed in the lamellar means is made with respect to stress concentration that can arise in critical areas and that should be avoided. The stress-distributing elements are essentially quadrangular in cross-section and cooperate with plane contact surfaces of the lamellar means. The plane contact surfaces define the hole in an essentially quadrangular configuration, the end of a predetermined contact surface connecting to a contact surface which is perpendicular to said predetermined contact surface by means of a concave bending in the wall of the lamellar means. The radius of the concave bending is made relatively large with the purpose of minimising stress concentration which arises in the areas of the corners of the hole.

As regards the shape, an advantageous design of the internal hole can also be described as two ovals which are parallel to one another as regards their long sides and which are separated by a quadrangular space.

Preferably, also the shape of the lamellar means is considered with respect to the operating conditions. Therefore, each lamellar means is suitably given such a shape that its extension in different directions is essentially proportional to the expected thrust in the corresponding directions. For example, the extension of the lamellar means in the vertical direction can be larger than in the horizontal direction, if the expected thrust is larger in the vertical direction. This may be the case if the direction of the pressing is essentially vertical. The number of winding turns which is arranged on the lamellar means is suitably adapted to the shape of the lamellar means in such a manner that sufficient prestress is obtained.

As mentioned above, the invention also relates to a method for manufacturing a press body part. There are a large number of advantages of the manufacturing technique according to the present invention, which will be evident in the following.

The lamellar means can be given the desired shape by milling or cutting. Different types of cutting are possible, a few examples being water cutting, plasma cutting and flame cutting. Those skilled in the art will realise that this is a considerably simpler process than the forming of the traditional compact press body by forging. Preferably, the lamellar means are made of hot-rolled steel sheet which subsequently is easily given the desired shape. In the present invention, it has turned out to be suitable to use a sheet thickness of 80–200 mm, preferably 100–150 mm, especially 100–120 mm.

Due to the fact that the lamellar means are separate units which, by degrees, together are to form a press body, manufacture can be accelerated considerably. Thus, various lamellar means blanks can be machined in the respective stations at the same time. A first lamellar means blank can be machined in a certain station and when this lamellar means blank has been moved on to a subsequent station for further machining, a second lamellar means blank can be machined at the same time in said certain station. This parallel managing of different manufacturing steps thus turns out to be very beneficial. It is also distinctly easier to move a relatively thin lamellar means in comparison with a large traditional press body. Preferably, some stations can process several lamellar means blanks simultaneously.

The lamellar means are easily transported to the location where the press of pressure cell type is intended to be used and assembled in situ.

Conveniently, a lamellar means is made in one piece. Alternatively, it can be made in several pieces and be suitably assembled to a lamellar means. Such an assembled lamellar means is firmly held together by means of bands which are wound round the external edge surface of the assembled lamellar means and/or with the aid of other locking means.

Due to the ease with which the lamellar means can be handled, unlike prior-art technique it is possible to move the press of pressure cell type relatively easily from one location to another by simple disassembling and reassembling of the lamellar means. If a separate lamellar means is to be removed or replaced due to maintenance, this can easily be made in the following way. The parts of the press of pressure cell type which are enclosed by the press body are suitably removed first from the press body, after which the lamellar means which is to be removed is released. The actual releasing can be carried out by displacing a first set of coupling means, which runs through the apertures formed in the lamellar means, along the direction of the main axis of the press out of a first end of the press, i.e. a lamellar means which defines one end of the press body. Almost at the same time, a second set of coupling means is inserted along the direction of the main axis into a second end of the press body, i.e. a lamellar means which defines the other end of the press body. The displacement of the first set and the insertion of the second set of coupling means are carried out in such a manner that the lamellar means which is to be released is contactless between said first and second set. Subsequently, the lamellar means is removed from the press.

If it is desirable to replace a removed lamellar means with a new lamellar means at the corresponding location, essentially the opposite is carried out compared to the method described above. First of all, a first set of coupling means is thus arranged through the apertures in the lamellar means which are positioned on one side of the location where the new lamellar means is to be incorporated, and then a second set of coupling means is arranged through the apertures in the lamellar means which are positioned on the other side of said location. Consequently, the coupling means should not protrude towards the centre more than to provide space for placing the new lamellar means. When the new lamellar means has been positioned in the press, the first set of coupling means is displaced through this lamellar means and the other lamellar means into which the second set of coupling means is inserted, at the same time as this second set is taken out of the press. Finally, only the first set of coupling means will thus run through all the lamellar means which constitute the press body.

Alternatively, a lamellar means can be released and replaced by pushing out a number of the coupling means, for example half the quantity, in one direction until they are detached from the lamellar means at issue, and pushing out the remaining coupling means in the opposite direction until they are detached from the lamellar means at issue. Thus, some coupling means will still be positioned in a group of lamellar means, whereas the remaining coupling means will be positioned in another group of lamellar means, no supplementary coupling means being required for the releasing process. When the replacement has been carried out, the coupling means are simply pushed back to their initial position.

When releasing and replacing a lamellar means, it is also conceivable to use an external stabilising beam which supports the other lamellar means with the purpose of increasing the stability in the construction.

A great advantage of the present invention is the accessibility to the internal portion of the press body. Since the lamellar means preferably are arranged at a distance from one another, it is possible to easily inspect the internal edge surface of a lamellar means, defining the internal hole. An inspection or testing device is simply inserted by the side of the lamellar means in question. If the lamellar means has adjacent lamellar means on both sides, it is thus possible to insert the testing device between the lamellar means in question and one of the adjacent lamellar means. This type of inspecting method is possible both when the press is pressurised and in a rest position.

According to a very advantageous embodiment of the invention, a special internal structure is formed in the press chamber. This structure comprises concentric, annular internal lamellar means which abut against one another and which each have a hole. The internal lamellar means are located in planes which are parallel to the direction of the main axis of the press chamber. Above the uppermost lamellar means, a press plate is arranged and below the lowermost hole, a bottom plate is arranged. Thus, the holes jointly form a space which is defined by the internal wall of the internal lamellar means, the press plate and the bottom plate.

Preferably, the internal lamellar means have several purposes; on the one hand, they may constitute a direct or indirect support for a tool on which, for example a metal sheet is to be shaped and, on the other, they can support or fasten various parts which are active in the press. For instance, a diaphragm which together with the press plate forms a pressure cell can be clamped between two lamellar means or the uppermost lamellar means and the press plate. Alternatively, the diaphragm can rest loosely against a shelf which protrudes from the uppermost lamellar means. A mat which is used to protect the diaphragm and is placed below the same can be fastened between two lamellar means. In a corresponding manner, the sheet can be fastened with the aid of suitable means.

Preferably, the internal lamellar means are integrated with limiting means for essentially permanently limiting the expansion of these lamellar means. Said limiting means conveniently comprise bands which are wound round the external edge surface of the lamellar means in a way corresponding to that of the lamellar means which form the press body. Thus, no external force-absorbing device is required on the short sides of the press chamber. The press construction can therefore be made relatively open by the short sides of the press chamber wall, i.e. the external sides of the internal lamellar means, being accessible to allow insertion and removal of the internal lamellar means. In the assembled press, preferably some of the internal lamellar means will at the ends of the press protrude from the actual press body.

Advantageously, the internal lamellar means are loosely arranged on the bottom plate and on one another. However, a sort of control element is arranged in order to ensure correct positioning. Due to the fact that the internal structure comprises lamellar means which are loosely arranged on one another, it is possible to remove them easily one by one or several of them at the same time.

Particularly great advantages are obtained by means of the above-described embodiment having internal lamellar means which are arranged on one another, especially as regards manufacturing, handling, freight and transport. In addition, these internal lamellar means are preferably made of the same kind of sheet-metal blank as the lamellar means which form the press body. Thus, each internal lamellar means, as well as the press-body-forming lamellar means, can be made in one piece or in several pieces.

Also other parts included in the press are suitable to be manufactured from a similar sheet-metal blank, for example press plate, bottom plate, distance means and stress-distributing element. This means that the manufacture of the parts included in the press essentially can be made at one location and the parts are, for example, delivered unassembled to the location where the press is to be used, after which the press is assembled in situ. Preferably, the press of pressure cell type is assembled in situ on a suitable type of foundation which keeps the construction in position.

DETAILED DESCRIPTION OF THE DRAWINGS

Figure 2B:
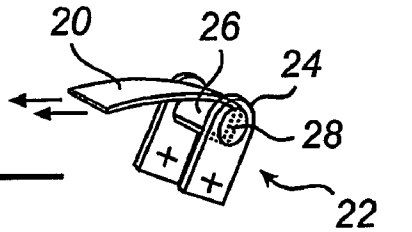
FIG. 2B illustrates one example of a device for locking a band.
Figure 2:
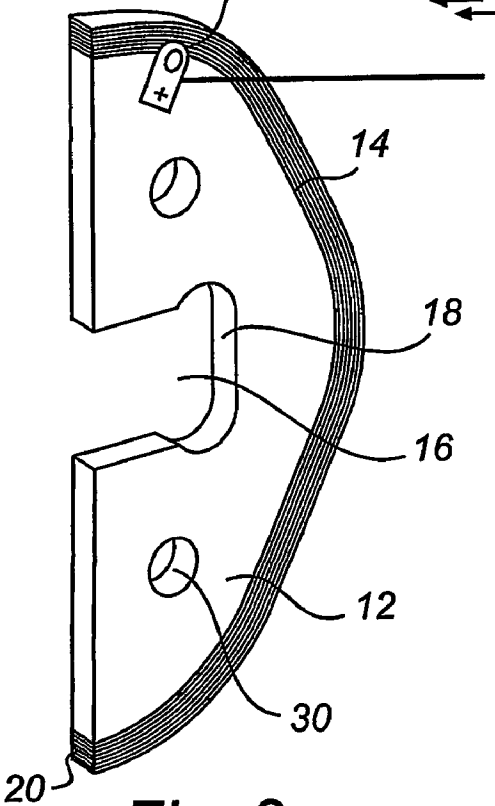
FIG. 2 is a perspective view in cross-section of the lamellar means in FIG. 1.
Figure 1:
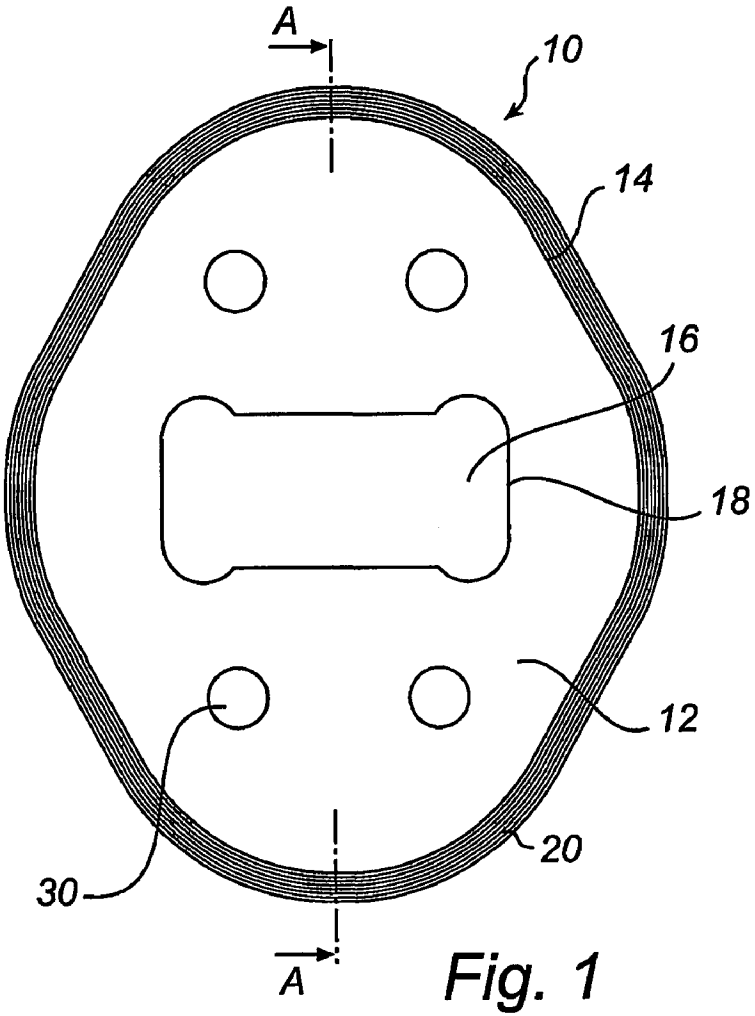
FIG. 1 is a side view of a lamellar means which is included in a press of pressure cell type shown according to one embodiment of the invention.

FIG. 1 is a side view of one embodiment of a lamellar means 10 which is included in a press of pressure cell type according to the invention. FIG. 2 is a perspective view in cross-section of the lamellar means 10 in FIG. 1. The cross-section is made along the line A—A in FIG. 1. These figures show that the lamellar means 10 is plate-shaped and thus has two side surfaces or main surfaces 12. The circumference of the lamellar means 10 is defined by a relatively narrow, circumferential, external edge surface 14. The lamellar means 10 is provided with a central through hole 16 which is defined by an internal edge surface 18. The hole 16 is essentially quadrangular, but without actual corners. The "corner regions" are instead rounded and bend inwards into the wall so that a larger hole area is obtained. The radii of these inward bends are made relatively large with the aim of minimising the stress concentration that arises in the corner regions.

The lamellar means 10 is essentially quadrangular and has rounded corners. The shape of the lamellar means is adapted to the expected thrust which arises in connection with the pressing. Thus, the material quantity or the distance between the internal and the external edge surface is larger vertically than horizontally since the main direction of pressing is vertical.

A plurality of turns of a band 20 of spring steel are wound round the external edge surface 14 of the lamellar means 10, the band 20 having a width which essentially corresponds to the thickness (about 120 mm) of the lamellar means 10. The height of the layer of band is about 100 mm and the layer can consist of one single long band or several joined bands. When the lamellar means 10 is being manufactured, the band 20 is wound round the same during resistance so that a compressive prestress is permanently induced in the lamellar means 10. As shown in FIG. 2 (not in FIG. 1), the lamellar means 10 can be provided with a type of control element 22 adjacent to the external edge surface 14 of the lamellar means 10 with a view to facilitating the winding of the band. This control element 22, which is shown more clearly in FIG. 2B, also operates as a device for locking the winding of the band. The device 22 comprises two side pieces 24 which are intended to be fastened on one side each of the lamellar means 10. A transverse roller 26 is fastened between the side pieces and is suitably intended to be arranged in a small hollow (not shown) in the external edge portion 14 of the lamellar means 10. The roller 26 is provided with a slit 28 into which the band 20 is inserted. When the locking is ready, the band is wound round the lamellar means 10. By the end of the winding process, i.e. in the outermost layer, there is essentially no tension. However, it is possible to lock also this end of the band using the technique known to those skilled in the art.

Apart from the central hole 16, the lamellar means 10 is formed with four circular apertures 30, two above and two below the hole. The apertures 30 are intended to receive the coupling means which will be presented in more detail in the following.

The lamellar means 10 is formed by hot-rolled steel plate having a thickness of 120 mm, preferably by milling or cutting. It is possible to assemble the lamellar means 10 from two or more parts, which subsequently by means of the turns of the band are connected to an integral unit. The height and width of the lamellar means are typically about 4000 mm and 3500 mm, respectively.

Figure 3:
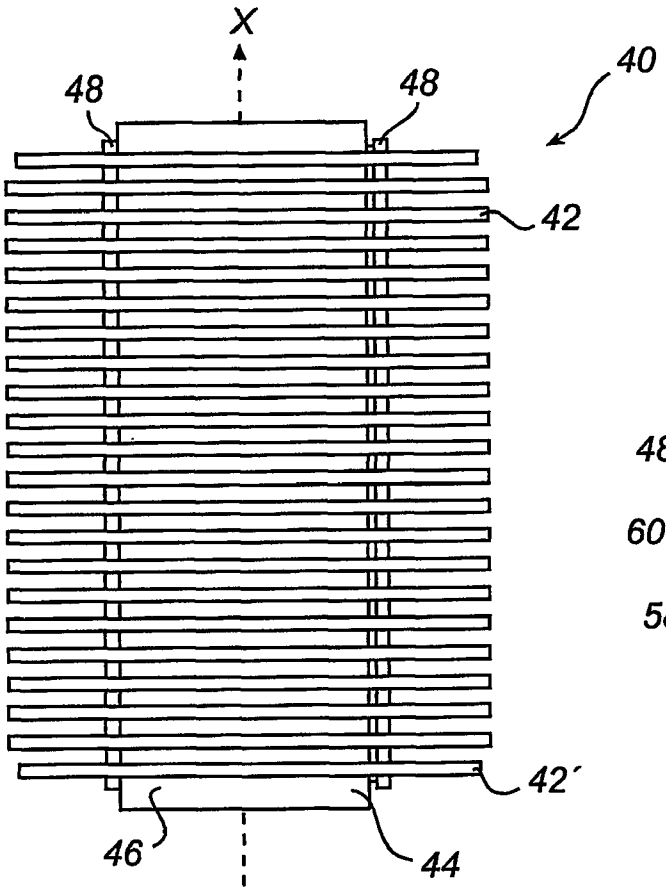
FIG. 3 is a top view of a press of pressure cell type according to one embodiment of the invention.

FIG. 3 is a top plan view of a press 40 of pressure cell type according to one embodiment of the invention. A number of lamellar means 42 are arranged next to one another in such a manner that the plane of the plate or main surface of each lamellar means 42 is parallel to the plate plane of the other lamellar means 42. The lamellar means 42 are equidistantly spaced from one another and they are of essentially the same size and thickness. The central holes are identical in all the lamellar means 42. The lamellar means 42 are positioned in such a manner that the central holes have a common centre axis, along which the serial holes or the internal edge surfaces of the lamellar means together in the form of a lattice define a space for housing a press chamber 44. The direction of the main axis X of the press chamber 44 coincides with the centre axis of the central holes. FIG. 3 shows an upper press chamber wall 46 and two side walls 48 which are perpendicular thereto.

Figure 4:
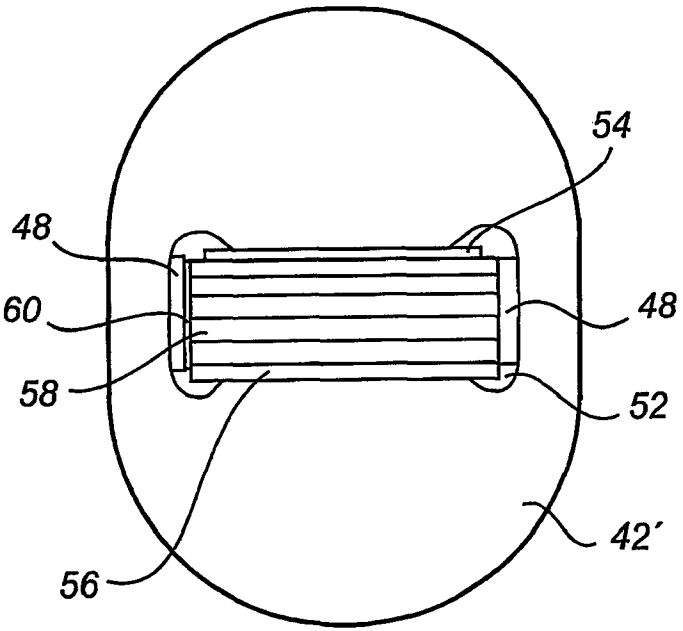
FIG. 4 is an end view of the press of pressure cell type in FIG. 3.

FIG. 4 is an end view of the press 40 of pressure cell type in FIG. 3. From the side it is thus possible to see the main surface of an end lamellar means 42' having the central hole 52. This lamellar means 42' contains in the hole 52 together with the holes of the other lamellar means 42 a press chamber in which, for example, a workpiece of sheet-metal or wood is intended to be machined. In the upper portion of the holes, a press plate 54 is arranged in contact with the internal edge surface of the lamellar means 42. Thus, the press plate 54 can constitute the upper press chamber wall 46 shown in FIG. 3. Furthermore, FIG. 4 shows that a bottom plate 56 is arranged in contact with the internal edge surface of the lamellar means 42 in the lower portion of the holes. Between these plates 54, 56, a number of plate-shaped internal lamellar means 58 which abut against one another are arranged. The main surfaces or the plate planes of these internal lamellar means 58 have an extension which is parallel to the direction of main axis of the press chamber. FIG. 4 also shows that the longitudinal side walls 48 of the press chamber shown in FIG. 3 have a height which essentially corresponds to the distance between the upper press plate 54 and the bottom plate 56. The internal lamellar means 58 are during pressing exposed to an internal overpressure, and because of this fact the lamellar means aim at expanding, whereby high tensile stress in the internal periphery of the internal lamellar means 58 is generated. For this reason, a generator 60 of horizontal force is arranged adjacent to the left side wall in the figure. This generator 60 predeforms and prestresses the deformation zones in the internal lamellar means.

Figure 5:
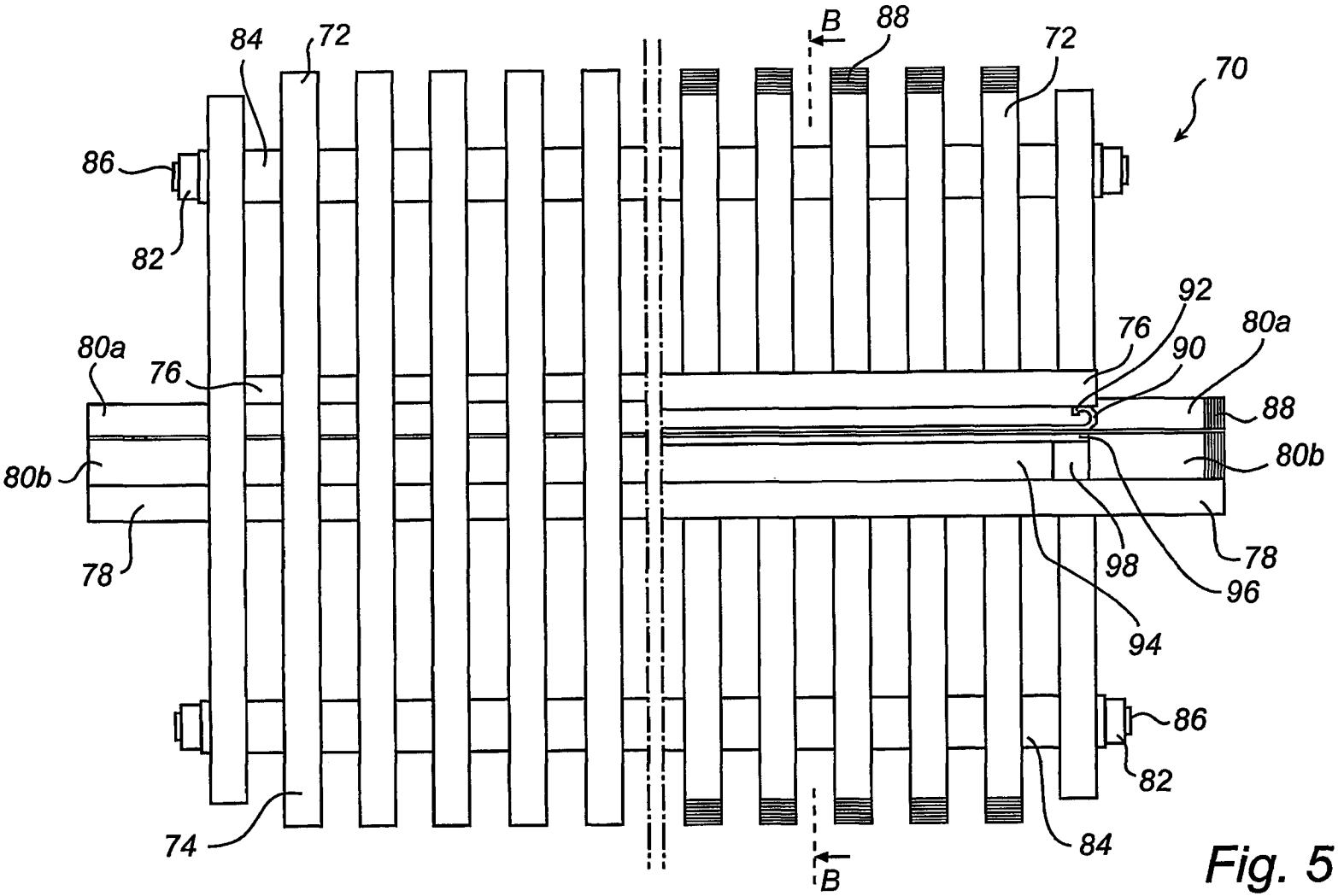
FIG. 5 is a side view, partly in cross-section, of a press of pressure cell type according to one embodiment of the present invention.

FIG. 5 is a side view, partly in cross-section, of a press 70 of pressure cell type according to one embodiment of the present invention. A central portion of the press 70 of pressure cell type is cut out of the Figure, to the left of the central portion an ordinary side view of the press being shown and to the right of the central portion a side view in cross-section of the press being shown. Thus, to the left in the Figure the external edge surface 74 of the lamellar means 72 which are comprised in the press is shown. An upper press plate 76 and a bottom plate 78 run through the central holes of the lamellar means 72. Between these plates, two internal lamellar means 80*a*, 80*b* which abut against one another are arranged. Through circular apertures which were described in connection with FIG. 1 and FIG. 2, in all lamellar means included in the press body, run coupling means 82 (two of which are shown), for example a steel rod having threaded ends. The lamellar means 72 are kept at a distance from one another by the fact that round each coupling means 82, between the lamellar means 72, there are distance means 84 having a thickness that is as large as the desired distance between the lamellar means. The distance means 84 are made of a relatively rigid material and their inner diameter is larger than that of the coupling means 82 at the same time as their external measures are essentially larger than the apertures arranged in the lamellar means 72. At the two external ends of the coupling means 82, outside the respective external lamellar means which are included in the press body, there are stop devices 86 of which at least one has a fixing and clamping mechanism which is complementary to the coupling means. In the case when the coupling means 82 comprises a rod being threaded at its ends, the attaching and stressing mechanism can comprise a washer and a nut, the washer having external measures which are essentially larger than the coupling apertures of the external lamellar means. The four coupling means 82 are thus tightened to a predetermined prestress condition. This eliminates play and motion in the construction and at the same time contributes to the structural stability of the constriction as regards flexural rigidity, torsional rigidity and resistance to extension in all dimensions.

As already mentioned, the right part of FIG. 5 is a side view in cross-section of the press 70 of pressure cell type. The cross-section is made at the centre of the press, i.e. along the main axis of the press chamber. FIG. 5 shows that the lamellar means 72 which constitute the press body are wound with a band 88 on the respective external edge surfaces. Moreover, the Figure shows that also the internal horizontal lamellar means which abut against one another are wound with a band. This winding 88 of the internal lamellar means 80*a*, 80*b* with a band is intended to essentially permanently limit expansion of the internal lamellar means, i.e. they must be able to withstand the forces which are formed in the press chamber. The internal lamellar means 80*a*, 80*b* are annular, which thus means that they define an internal, open space which is comprised in the press chamber. In addition, FIG. 5 shows an upper internal lamellar means 80*a* and a subjacent lower internal lamellar means 80*b*. A diaphragm 90 is arranged in the open space of the upper internal lamellar means 80*a*. The diaphragm 90 has a seal 92 against the press plate 76 and forms a pressure cell therewith. During operation, a pressure medium is supplied to the pressure cell in such a manner that the diaphragm 90 expands. The open space 94 of the lower internal lamellar means 80*b* is intended to contain a tool. A metal sheet which is to be pressed against the tool is suitably arranged above the tool, the diaphragm 90, when being pressurised, expanding and being formed on the tool, which means that the metal sheet that is located therebetween is also formed on the tool. Besides, the Figure shows that a mat 96 is arranged just below the diaphragm. The carpet 96 takes part in the forming of the plate and at the same time protects the diaphragm against wear. Adjacent to the internal wall of the lower internal lamellar means 80*b*, a filling element 98 of rubber is arranged with the aim of distributing forces and of supporting the tool. If a piece of wood is to be pressed, this can be carried out without any tools.

Figures 6A, 6B:
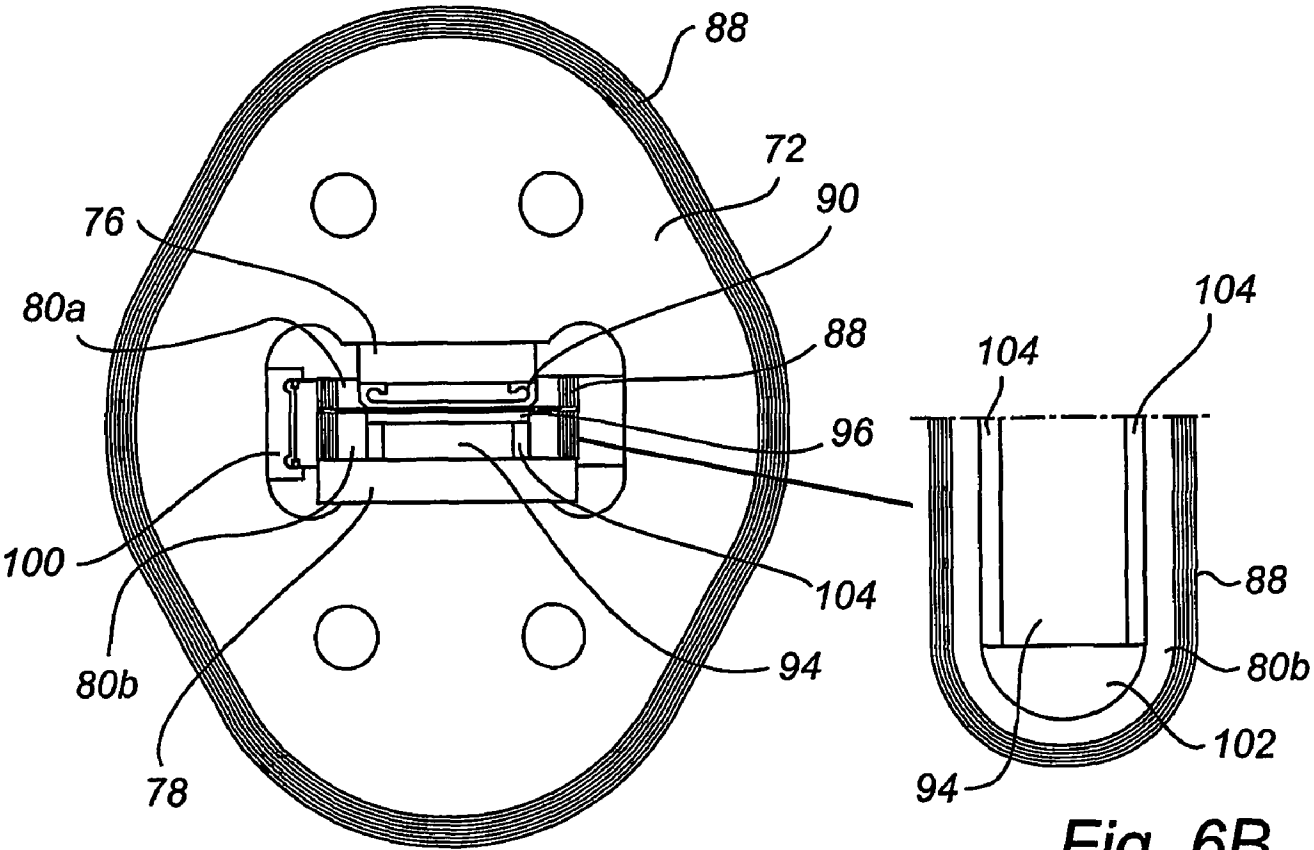
FIG. 6A shows the press of pressure cell type in cross-section along the line B—B in FIG. 5.
FIG. 6B is a top view of a detail in FIG. 6A.

FIG. 6A shows a press of pressure cell type in cross-section along the line B—B in FIG. 5. This Figure shows a hydraulic compensator or generator 100 of horizontal force, which thus affects the internal lamellar means horizontally. Unlike the integrated wound bands 88, this generator is separate from the internal lamellar means 80*a*, 80*b* and is adapted to apply these radially prestressing or predeforming forces (cf. FIG. 4). Conveniently, the generator comprises hydraulic pistons. As shown in FIGS. 5 and 6*a*, the upper internal lamellar means 80*a* has such an extension that its upper portion encloses the press plate 76, the internal dimension of the lamellar means 80*a* essentially corresponding to the outer dimension of the press plate 76. This contributes to satisfactory sealing of the pressure cell.

FIG. 6B is a partial top view of the lower internal lamellar means 80*b* in FIG. 6A. Thus, it is shown that this lamellar means 80*b* has the form of a "running track", i.e. its wall is defined by two parallel straight portions which at the ends are connected to one another by convex semicircles. In the space just inside the respective semicircles, a semi-circular filling block or end block 102 of resilient material, such as rubber, is fitted so that the remaining free space is quadrangular. The purpose of the end blocks 102 is, among other things, to serve as support for the tool. Straight resilient supports 104 which are parallel to the direction of the main axis of the press chamber can also be arranged adjacent to the straight wall portions. These supports 104 and end blocks 102 (which correspond to the filling element 98 in FIG. 5) also have a protecting function in the sense of protecting and prolonging the service length of the internal lamellar means by distributing forces which are generated during pressing operations. Since the internal lamellar means 80*a*, 80*b* are prestressed by the turns of the band 88, no external limiting means are required and therefore, for example, the semi-circular portions can protrude from the ends of the press body as shown in FIG. 3 and FIG. 5. Since the internal lamellar means 80*a*, 80*b* protrude, they are relatively easily accessible, which is time-saving when metal sheets are removed, tools are replaced, diaphragms are replaced etc.

Figure 7A:
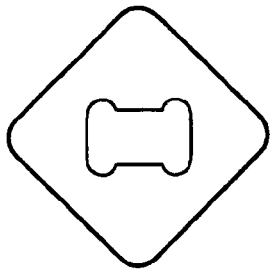
FIGS. 7A–7E schematically illustrate different variants of lamellar means.
Figure 7B:
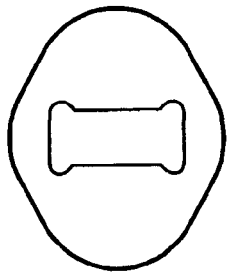
Figure 7C:
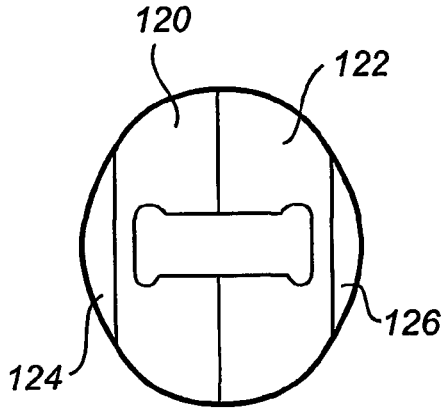
Figure 7D:
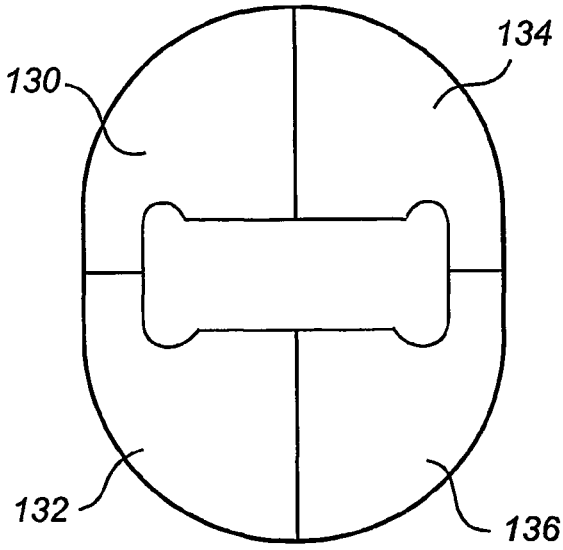
Figure 7E:
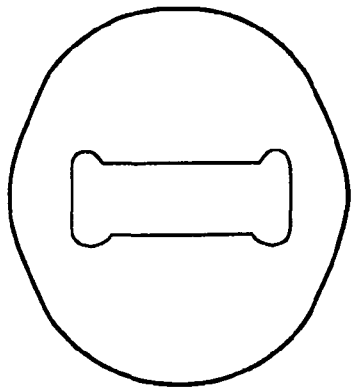

FIGS. 7A–7E schematically illustrate different variants of lamellar means. As these Figures show, lamellar means can be made in different sizes and have different shapes. The lamellar means shown in FIG. 7A essentially has the shape of a square having rounded edges and is suitably used for a press body which gives a load space of 100×200×2500 $mm^3$. The working pressure in such a space is typically 1200 bar. FIG. 7B illustrates another possible shape which together with identical lamellar means forms a press body which gives a load space having the dimensions 125×500×1500 $mm^3$ and a typical working pressure of 700 bar. FIG. 7C illustrates a lamellar means which is composed of several parts and thus, unlike the previously shown lamellar means, is not made in one piece. In this case, two central parts 120, 122 together form the central hole. Two external parts 124, 126 are arranged at the external edge of the respective central parts in such a manner that a lamellar means of a suitable shape is provided. The four parts included in the lamellar means are held together by the turns of the band (not shown). This lamellar means is somewhat smaller than, but has essentially the same shape as, the lamellar means in FIG. 7E, which, however, is made in one piece and provides a load space having the dimensions 200×1100×200 $mm^3$. FIG. 7D shows another variant of a lamellar means which is made of several parts. In this case, there are four essentially uniform parts which together form a lamellar means. Consequently, an upper left part 130, a lower left part 132, an upper right part 134 and a lower right part 136 are shown. These are held together by means of the previously described turns of the band (not shown). As a possible alternative, a lamellar means corresponding to that shown in FIG. 7D could be made of two halves only, such as a left half and a right half, instead of four parts. The lamellar means in FIG. 7D provides with other corresponding lamellar means a load space having the dimensions 400×1600×4000 $mm^3$.

Those skilled in the art will thus understand from the examples illustrated above that the lamellar means can be made in one or more pieces, be given different shapes and be made in different sizes as regards both external and internal dimensions.

Although some preferred embodiments have been described above, the invention is not limited thereto. It is thus possible to use variants of the internal structure other than those described. The design of the individual lamellar means can also be varied in accordance with the current needs. It should thus be understood that a plurality of modifications and variations can be provided without deviating from the scope of the present invention which is defined in the appended claims.

The invention claimed is:

1. A press comprising:

a press chamber including a pressure cell, the press chamber having a main axis; and a force-absorbing press body enclosing the press chamber, the press body including a number of plates, each plate having an internal edge surface defining a through hole having a center axis, an external edge surface, and a prestressing element wound around the external edge surface;

wherein the number of plates are parallel to each other, such that the center axis of each through hole coincides with the main axis of the press chamber; and wherein each prestressing element is band-shaped and has a width substantially equal to a thickness of a corresponding plate.

2. The press as claimed in claim 1, wherein the plates of the press body are arranged at a distance from one another corresponding to the thickness of one of the plates.

3. The press as claimed in claim 1, wherein each plate of the press body is provided with a number of apertures which are aligned with corresponding apertures of other plates so that a number of series of apertures are formed, which are parallel to the main axis of the press chamber, and wherein coupling means for coupling plates extends through a respective one of said series of apertures.

4. The press as claimed in claim 3, wherein distance means is arranged on said coupling means for controlling the relative distance between adjacent ones of the plates of the press body.

5. The press as claimed in claim 1, wherein stress-distributing elements extending over the press chamber are arranged between the plates of the press body and the press chamber which is enclosed by said plates, the stress-distributing elements cooperating with the internal edge surfaces of the plates.

6. The press as claimed in claim 5, wherein the stress-distributing elements constitute parts of a wall of the press chamber.

7. The press as claimed in claim 5, wherein the stress-distributing elements define a portion in the press chamber which in cross-section has a quadrangular configuration, and cooperate with first planar portion of the internal edge surface of each of the plates of the press body.

8. The press as claimed in claim 7, wherein the first planar portion of the internal edge surface of each of the plates of the press body defines the through hole in a quadrangular configuration, and wherein the internal edge surface has a second planar portion, which is perpendicular to said first planar portion, and which is connected to said first planar portion via a concave bend in the internal edge surface.

9. The press as claimed in claim 1, wherein each plate of the press body has radial dimensions, which extend outwardly from the internal edge surface to the external edge surface, that are proportional to an expected thrust in the radial directions, respectively.

10. The press as claimed in claim 9, wherein during a pressing operation, the press has a main pressing direction, and the material quantity or the distance of each plate of the press body between the internal and the external edge surfaces is larger in the main pressing direction than in a direction perpendicular thereto.

11. The press as claimed in claim 1, wherein an internal structure is arranged in the press chamber, which structure is made up of a number of concentric plates abutting against one another and each having a through holes and being located in a planes which is parallel to the main axis of the press chamber, a workpiece to be worked upon in a space which is formed of the through holes of the concentric plates.

12. The press as claimed in claim 11, wherein an external edge surface of each of the concentric plates of the internal structure is wound with a band of the same width as a thickness of the respective concentric plate, for prestressing thereof.

13. The press as claimed in claim 11, wherein the plates of both the internal structure and of the press body are made of the same material and have the same thickness.

14. The press as claimed in claim 11, wherein at least one of the plates of the internal structure or of the press body is made in one piece.

15. The press as claimed in claim 11, wherein at least one of the plates of the internal structure or of the press body is made in several pieces.

16. The press as claimed in claim 11, wherein the plates of the internal structure and of the press body are made of sheet steel.

17. A method for manufacturing a force-absorbing press body part to enclose a press chamber, comprising:

providing a plurality of plates, each of the plates having a through hole;

inducing a lasting compressing prestress which acts in a plane of at least one of the plurality of plates by winding a band-shaped prestressing element, which has substantially the same width as a thickness of a corresponding plate, around an external edge surface of the corresponding plate; and arranging the plurality of plates parallel to each other so that a center axis of each of the through holes coincide with each other and so that the plurality of plates constitute a force-absorbing, press-chamber-enclosing press body part.

18. The method as claimed in claim 17, wherein the plates are arranged at a distance from one another that corresponds to a thickness of one of the plates.

19. The method as claimed in claim 17, further comprising the step of giving plates a desired shape by milling.

20. The method as claimed in claim 17, further comprising the step of giving the plates a desired shape by cutting.

21. The method as claimed in claim 17, wherein the forming step comprises the step of making the plates of hot-rolled sheet steel.

22. The method as claimed in claim 17, wherein the forming step comprises the step of making the plates of sheet steel having a thickness of 80–200 mm.

23. The method as claimed in claim 17, wherein the forming step comprises making the plates in sequence in a number of stations according to the steps of:

machining a first plate blank in an appropriate station;

conveying said first plate blank to a subsequent station for further machining; and machining a second plate blank in said appropriate station at the same time as said first plate blank is being machined in said subsequent station.

24. The method as claimed in claim 23, wherein one of said stations comprises parallel machining of a plurality of plate blanks.

25. The method as claimed in claim 17, further comprising:

assembling the plates to a press body at the location where a press is to be used; and holding the plates together a unit via coupling means.

26. The method as claimed in claim 17, further comprising the step of making each of the plates in one piece.

27. The method as claimed in claim 17, further comprising the step of making each of the plurality of plates in several pieces.

28. A press body part, comprising:

a plate-shaped body;

a through hole in the body;

an internal edge surface which defines the hole;

an external edge surface of the plate-shaped body; and a prestressing means arranged on the external edge surface, for inducing a compressing prestress acting in the plane of the plate-shaped body, the prestressing means including a prestressing element which is wound around the plate-shaped body and is band-shaped and has substantially the same width as the thickness of the plate-shaped body.

29. The press body part as claimed in claim 28, wherein the plate-shaped body is made of sheet steel.

30. A method for working a part, comprising:

placing the part within a press chamber of a press body, the press chamber having a main axis, the press body including a plurality of plates, each of the plurality of plates having a through opening formed therein with an edge of the opening defining load surfaces and the plurality of plates being positioned parallel to each other, such that a center axis of the openings of the plates coincide with the main axis of the press chamber; and pressing in against the part within the press chamber to work the part while pressing out against the load surfaces of each of the plurality of plates, at least one of the plurality of plates being prestressed by a tensioned band positioned around an outer edge thereof.

* * * * *